United States Patent [19]

Rota

[11] Patent Number: 4,970,831

[45] Date of Patent: Nov. 20, 1990

[54] SHAPE-ADJUSTABLE BEARING STRUCTURE

[76] Inventor: Angelo Rota, Etzelstrasse 14,, 8820 Wadenswil, Switzerland

[21] Appl. No.: 301,757

[22] PCT Filed: Apr. 14, 1988

[86] PCT No.: PCT/CH88/00079

§ 371 Date: Dec. 14, 1988

§ 102(e) Date: Dec. 14, 1988

[87] PCT Pub. No.: WO88/08060

PCT Pub. Date: Oct. 20, 1988

[30] Foreign Application Priority Data

Apr. 15, 1987 [DE] Fed. Rep. of Germany ..... 3712760

[51] Int. Cl.[5] ..... E04B 1/345; A47C 7/00

[52] U.S. Cl. ..... 52/2 J; 297/440

[58] Field of Search ..... 297/440–444; 312/258; 108/153, 157; 211/182, 175; 160/135; 52/2 J

[56] References Cited

U.S. PATENT DOCUMENTS

| | | | |
|---|---|---|---|
| 510,427 | 12/1893 | Hine | 160/135 |
| 2,100,979 | 11/1937 | Rowe | 297/442 |
| 2,324,398 | 7/1943 | Kahr | 160/135 |
| 2,546,811 | 3/1951 | Anderson | 297/440 |
| 2,733,482 | 2/1956 | Doman et al. | 52/80 |
| 3,933,401 | 1/1976 | Lampe et al. | 312/258 |
| 3,938,860 | 2/1976 | Cobb | 297/440 |
| 3,973,363 | 8/1976 | LaPorte et al. | 52/2 J |

FOREIGN PATENT DOCUMENTS 971148 9/1964 United Kingdom .

*Primary Examiner*—James L. Ridgill, Jr.

*Attorney, Agent, or Firm*—Tarolli, Sunheim and Covell

[57] ABSTRACT

In bearing structures which can be converted from a rest shape to an operational shape of larger volume and have at least one flat bearing part (1) and at least one support part (2) movable with and/or detachable therefrom, the problem consists in achieving good shape retention and in particular high resistance to bending without affecting the geometrical adaptability. The solution is achieved through three features: (a) the flat bearing part (1) is essentially resistant to bending in the first normal plane (NE1) and comparatively flexible in at least a second normal plane (NE2) at an angle to the first normal plane; (b) the bearing part (1) has an at least sectionally-curved functional shape; (c) when the bearing structure is in its operational shape the support part (2) is connected in a push-resistant manner with at least one region of the bearing part (1) which extends at an angle to the first normal plane (NE1).

10 Claims, 10 Drawing Sheets

FIG. 1
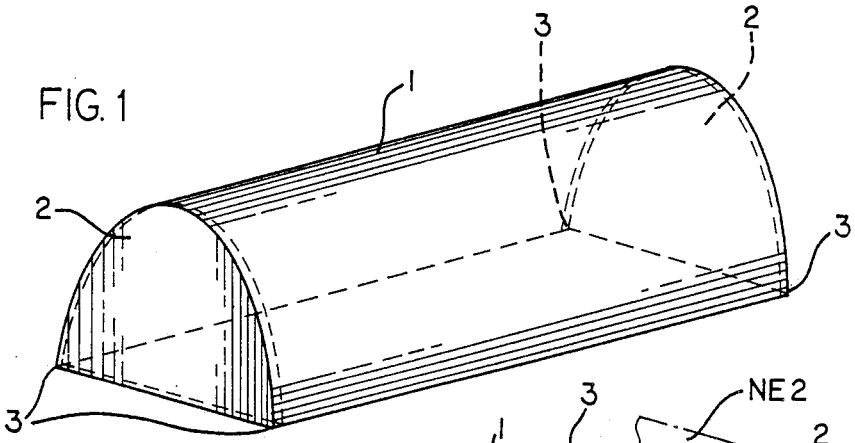
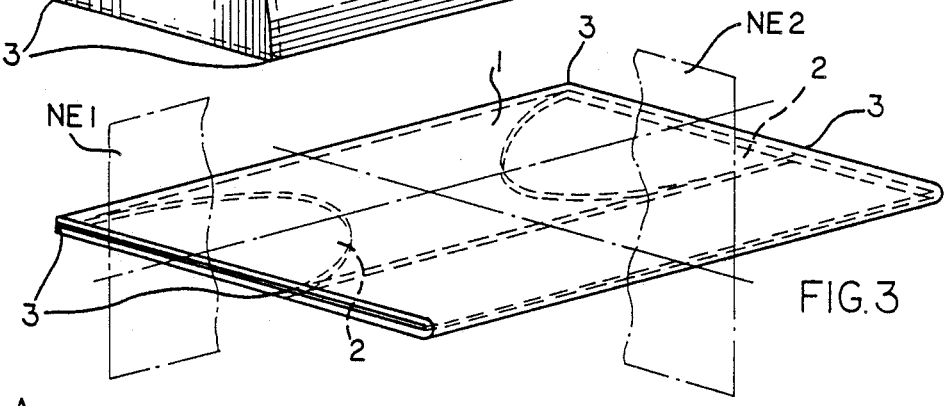
FIG. 3
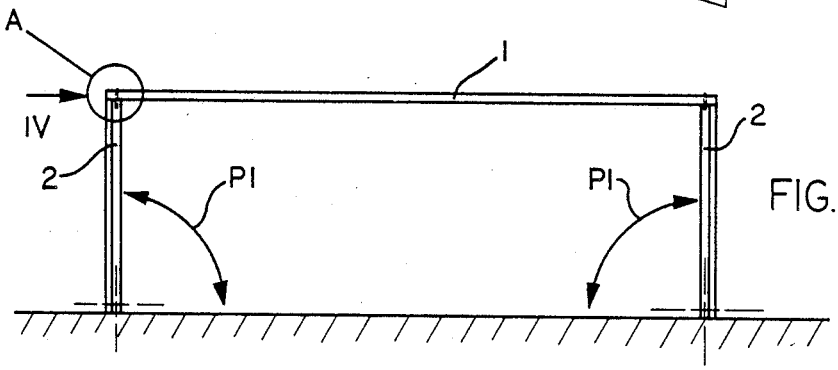
FIG. 2

SHAPE-ADJUSTABLE BEARING STRUCTURE

TECHNICAL FIELD

The invention relates to the kind of bearing structure which is adjustable between a rest shape and an operational shape of greater volume and has at least one flat bearing part and at least one support part connected movable with and/or detachable from the same.

The problem of the invention is to provide a bearing structure of the kind mentioned which, without impairing the adjustability between a rest shape requiring little space and an operational shape of greater volume, is distinguished by high rigidity of form and especially rigidity or resistance against bending.

Essential to this solution is the distinguished anisotropy of direction of the flat bearing structure, as to the bending rigidity, in combination with the push-resistant connection, that is, rigidity against the transfer of tangential thrust tensions, and connection with bearing strength between the bearing structure and the support part. Also essential is an extension of a portion of the bearing structure connected with the support part at an angle (preferably at least approximately perpendicular) with the anisotropy of high bending rigidity of the same. As a whole, there is given through these features, in the operational shape, a shape of high strength rigid in form both against pressure and also against bending stresses which, through partially or complete loosening of the push-resistant connection, can be converted into a space-saving rest shape.

One variation of the problem of the invention is directed, in a bearing structure of the same kind, to being able to carry out simply and rapidly the adjustment between rest and operational shapes, and to reducing the construction expense for the stiffening of the bearing parts. A further development of the invention solving this problem is specified by the features of claim 6.

With this solution, a bearing structure anisotropic as to bending stiffness, according to the first solution, is also present. But here it is mainly a matter of the fact that a support part at least partly rigid, and its push-resistant connection wholly or partly detachable with the bearing structure, is no longer necessary. With this is given the desired simplification as to structure and handling. The hollow chamber of the bearing structure is filled with a pressure fluid to provide a stiffening of the operational shape curved or angled in sections. Thus, rigidity against bending is provided. But as compared with the first solution, this is relatively yielding without special precautions against pressure stress. This has hardly any disturbing effect in many applications and can be tolerated there in view of the special advantages.

BRIEF DESCRIPTION OF THE DRAWINGS

The invention will be further explained from examples schematically represented in the drawing.

FIG. 1 shows a perspective view of a bearing structure designed as a hangar in operational shape;

FIG. 2 is a lengthwise vertical section of the bearing structure in operational shape according to FIG. 1;

FIG. 3 is a representation in perspective of the bearing structure, according to FIG. 1, in rest shape;

DESCRIPTION OF PREFERRED EMBODIMENTS

The bearing structure represented in FIGS. 1 and 2 in its operational shape forms an elongated hall or cabin with an arch-type mantle. A bearing part 1 designed as part of a cylindrical surface has ends adapted in their outline to the inner profile of the mantle. The ends are set into plate-shaped support parts 2. Here, it should be noted that the support parts 2 might be designed with the advantage of greater simplicity and saving of weight.

Figure 4:
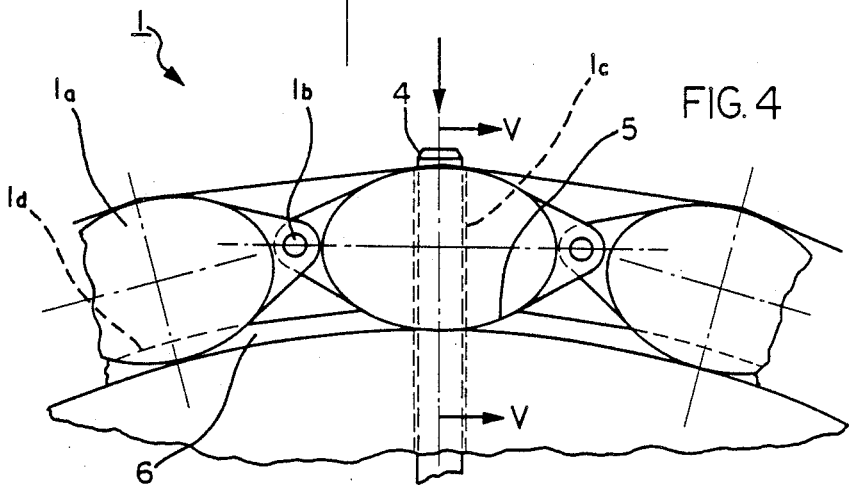
FIG. 4 is a partial view, on a larger scale from FIG. 2 in region A, looking in the direction of the arrow IV.

As indicated in FIG. 4, the bearing part 1 consists of rod-shaped bearing elements 1*a* lying side-by-side and extends in the lengthwise direction of the cylinder of the mantle. The bearing elements 1*a* are joined together on their neighboring lengthwise sides by joints 1*b*. As a whole, therefore, the bearing part 1 is a flat object which in the normal plane NE1, indicated in FIG. 3, is rigid and has considerable resistance to bending in relation to the bending moments acting in the plane. But in the normal plane NE2 arranged perpendicular to the normal plane NE1, the bearing part 1 bends easily and is movable in joint fashion because of the joint 1*b*.

In operational shape according to FIG. 1, the support parts 2 form a stiffening for the cylindrical profile of the bearing part 1 so that the easy bending or mobility in the normal plane NE2 cannot take effect. There is given in this way in the operational shape as a whole, a hollow body rigid in form.

As shown in FIG. 2, the folding of the bearing structure into the rest shape takes place by swinging in the support parts 2, according to the arrows P1, around joints 3 which connect the lower corner regions of the support parts 2 with the neighboring regions of the bearing part 1. These joints are suitably provided in a known manner and are not shown in detail. Several rotating axes arranged opposite each other at an angle are swung so that after the swinging of the support parts 2 into the horizontal (see FIG. 3), without loosening of the joint connections, a conversion of the bearing part 1 into a flat shape can be done. This is distinguished by especially small space requirements, and makes possible, if desired, the supporting of the connected construction unit. The use of universal ball joints offers special advantages in many applications while one piece bending joints, as known, offer the advantage of the greatest simplicity.

On the other hand, it should be emphasized that a detachable connection between the bearing part 1 and the support parts 2 can also offer special advantages. Not only is the construction of the connecting elements or joints simpler, but the bearing part 1, separated from the support parts 2 in the rest shape, can be folded together to still smaller sizes without limitation, for example, by rolling up or folding in a zig-zag.

Figure 5:
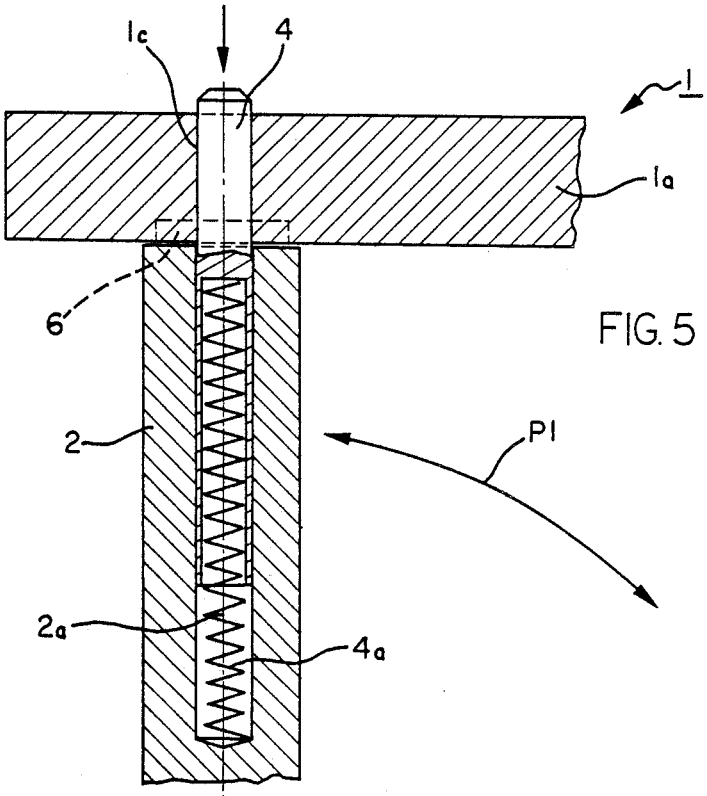
FIG. 5 is a partial section, on the scale according to FIG. 4, along the section plane V in FIG. 4.

For return into the operational shape, the support parts 2 are swung outward, according to the arrows P1, with straightening and conversion of the bearing part 1 into its curved profile shape. For locking into the operational shape, pin-shaped fastening elements 4 are provided, as shown in FIGS. 4 and 5, which are set movable lengthwise into bores 2*a* of the support parts 2. Each of the fastening elements 4 is under the pressure, directed outward, of a spring 4*a*. With the raising of the support parts 2, the fastening elements 4 are pressed into their bores 2*a* until after reaching the operational shape of the bearing structure. They are caught under spring pressure in fitted cross bores 1*c* of the bearing elements 1*a*. This produces a shape-fitting, push-resistant connection between the bearing part 1 and the support parts 2. The push-resistant quality acts, in this case, in all directions tangent to the bearing part 1, and particularly in any case, transverse to the normal plane NE1 or parallel to the normal plane NE2, as this is essential to the shaping of a hollow body rigid in form. Moreover, to produce such a push-resistant quality within the circumference of the support parts 2, the profile of the bearing elements 1*a* are provided with fitted depressions 5. The effectiveness of these push-resistant connections, also acting transverse to the normal plane NE1, is suitably increased by setting the bearing part 1, under tangential pulling tension, onto the circumferential contour of the support parts 2. In the case of a strong bearing connection between the corner regions of the support parts 2 and the bearing part 1, this may be attained simply by a corresponding dimensioning of the length of the circumference or possibly also by means of special tension means, as known and therefore not shown. Also, if desired, with omission of the push connection directed transverse to the normal plane NE1, there may be provided on one or more of the bearing elements 1*a* a transverse groove 1*d* in which engages a ridge-shaped additional piece 6 on the circumference of the support parts 2. This provides for a strengthened shape-fitting connection, which may be desired, directed parallel to the normal plane NE1.

Figure 6:
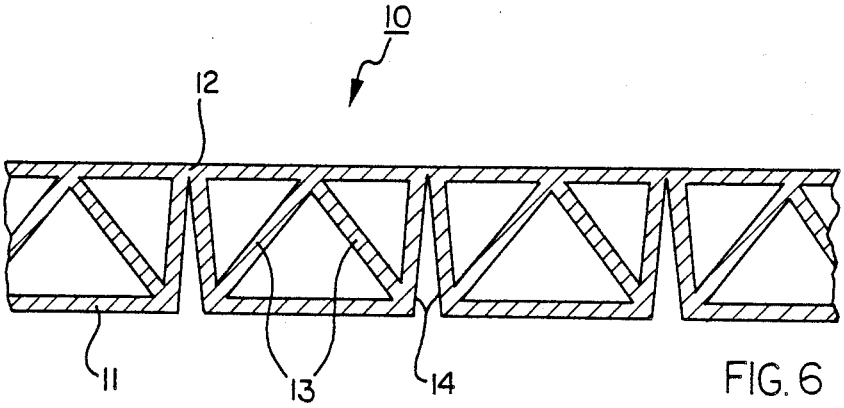
FIG. 6 is a partial cross-section of the wall of a bearing structure according to the invention, in rest shape.
Figure 7:
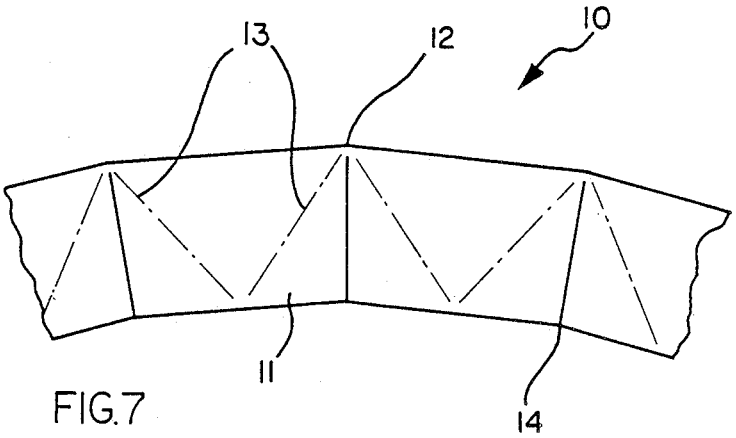
FIG. 7 is a simplified diagram of the wall section according to FIG. 6, but in operational shape.

A bearing part 10, represented in FIGS. 6 and 7 by a cross-section of a wall, also consists of bearing elements 11 arranged lying side-by-side. The bearing elements 11 are elongated and rigid against bending in their lengthwise direction, and are connected swingable with each other on their long sides. Special here is the design of these side connections in the form of bending joints 12. This makes possible, in particular, a one-piece production of a plurality of bearing elements lying side-by-side. That is, one section of the bearing part 10 or even a whole bearing part 10, together with the joints lying between, can be produced as an extruded press or extruded cast part, preferably of a suitable plastic. The bearing elements 11 may be designed as hollow profiled rods, and suitably with strip-shaped inner profile sections 13. This provides a high rigidity of the profile sections 13 against thrust deformation. In the operational shape according to FIG. 7, with profiled sides 14 of the bearing elements 11 lying against each other, there is given in this way a hollow profiled wall of especially great rigidity against torsion.

Figure 8:
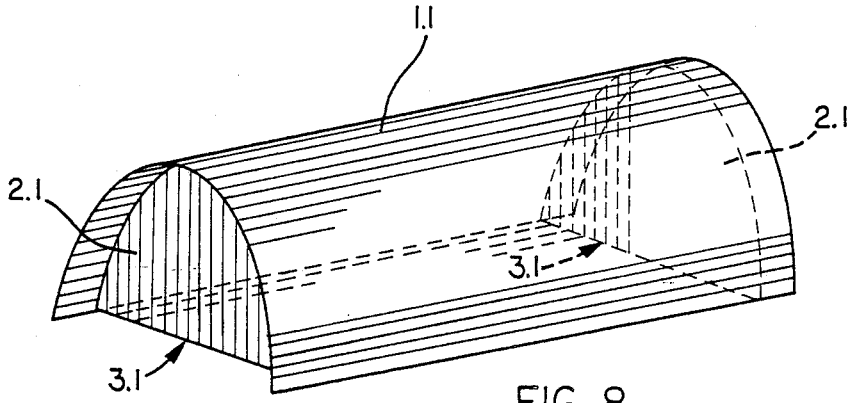
FIG. 8 is a perspective view of another bearing structure designed as a hall in operational shape.
Figure 9:
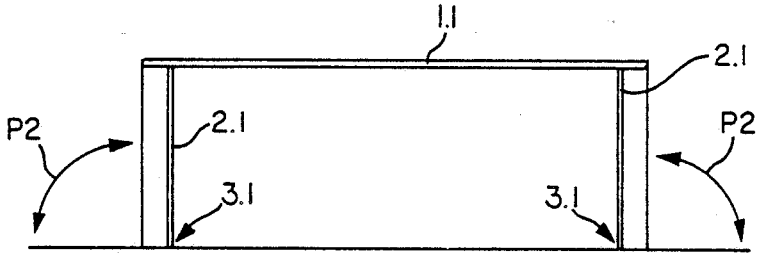
FIG. 9 is a lengthwise vertical section of the bearing structure in operational shape according to FIG. 8.

The bearing structure represented in FIGS. 8 and 9 in its operational shape also forms a hall or cabin. In this bearing structure, not only bearing part 1.1 but also support parts 2.1 consist of rod-shaped bearing elements lying side-by-side and rigid against bending. The neighboring long sides are joined together by joints, as according to FIG. 4 or FIG. 6.

Figure 10:
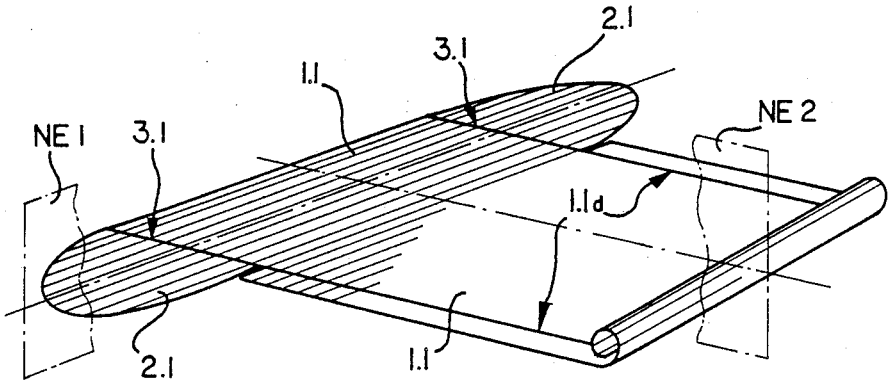
FIG. 10 is a perspective view of the bearing structure according to FIGS. 8 and 9, in rest shape.

The support parts 2.1 are swingable outward and are joined by a rim section 1.1.1 of the bearing part 1.1 as shown by arrow P2 in FIG. 9. Individual joints or hinges 3.1 are provided between the individual adjoining bearing elements of the bearing part 1.1 in each case and the support parts 2.1 in each case. In this way, the bearing structure can be rolled up as a whole. Between two bearing elements of the bearing part 1.1, a detachable connection is provided so that the bearing structure, as shown in FIG. 10, can be converted into a one-layer flat shape. In FIG. 10, two transverse grooves are marked 1.1*d* in which the circumference of the two support parts 2.1 or the ridge-shaped additions on this circumference can engage in the operational shape in the manner already explained from FIGS. 4 and 5.

Figure 11:
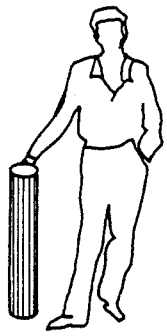
FIG. 11 under (*a*) to (*f*), are perspectives of another bearing structure designed as a seat (a piece of furniture)
Figure 11B:
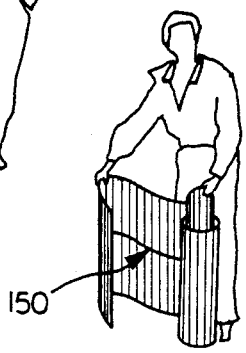
Figure 11C:
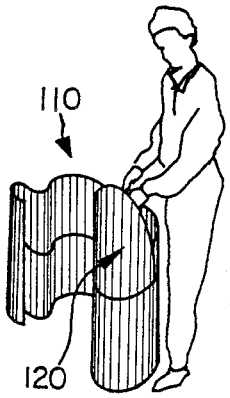
Figure 11D:
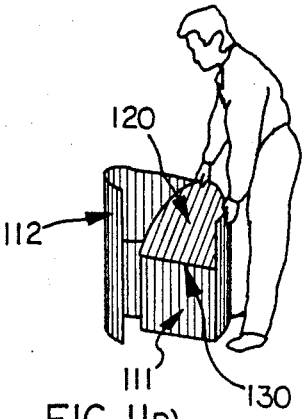
Figure 11E:
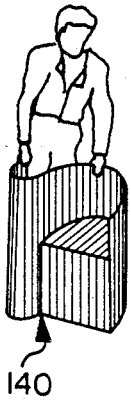
Figure 11F:
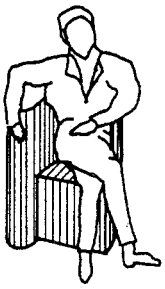

FIG. 11 shows under (*a*) to (*f*) a bearing structure which in its operational shape, according to FIG. (*e*) and (*f*), is a seat. The bearing part 110 and the support part 120 consist of rod-shaped bearing elements lying side-by-side and rigid against bending. The neighboring long sides are joined together by joints, as according to FIG. 4 or FIG. 6.

The support part 120 is swingable and is connected with a rim section 111 of the bearing part 110. Individual joints or hinges 130 are provided between the individual bearing elements of the bearing part 110 adjoining each other and the support parts 120 in each case. In this way, the bearing structure can be rolled up as a whole. Against the rim section 111 of the bearing part 110 closes another section 112 of greater height.

FIG. 11(*a*) shows the bearing structure rolled together into its most compact rest shape in which it is easily portable. For conversion into the operational shape, the bearing structure is partly rolled up. The support part 120 serves in the operational shape as a seating surface. As shown under (*d*) in FIG. 11, the support part 120, with the bearing part 110 standing vertical, is folded into a horizontal position. Then the other section 112 of the bearing part 110 is brought tightly around the support part 120, and is secured in this position by a suitable closing 140 between the other section 112 and the rim section 111. By the height of the other section 112 of the bearing part 10, the height of the chair back is determined. To hold or fix the support part 120 in its horizontal position in the operational shape, a suitable offset or a groove or channel suitable to receive the circumference of the support part 120 is provided at the height of the support part 120 and in the other section 112 of the bearing part 110. This is shown in FIG. 11(*b*) and 11(*d*) and is marked 150.

Figures 12, 13:
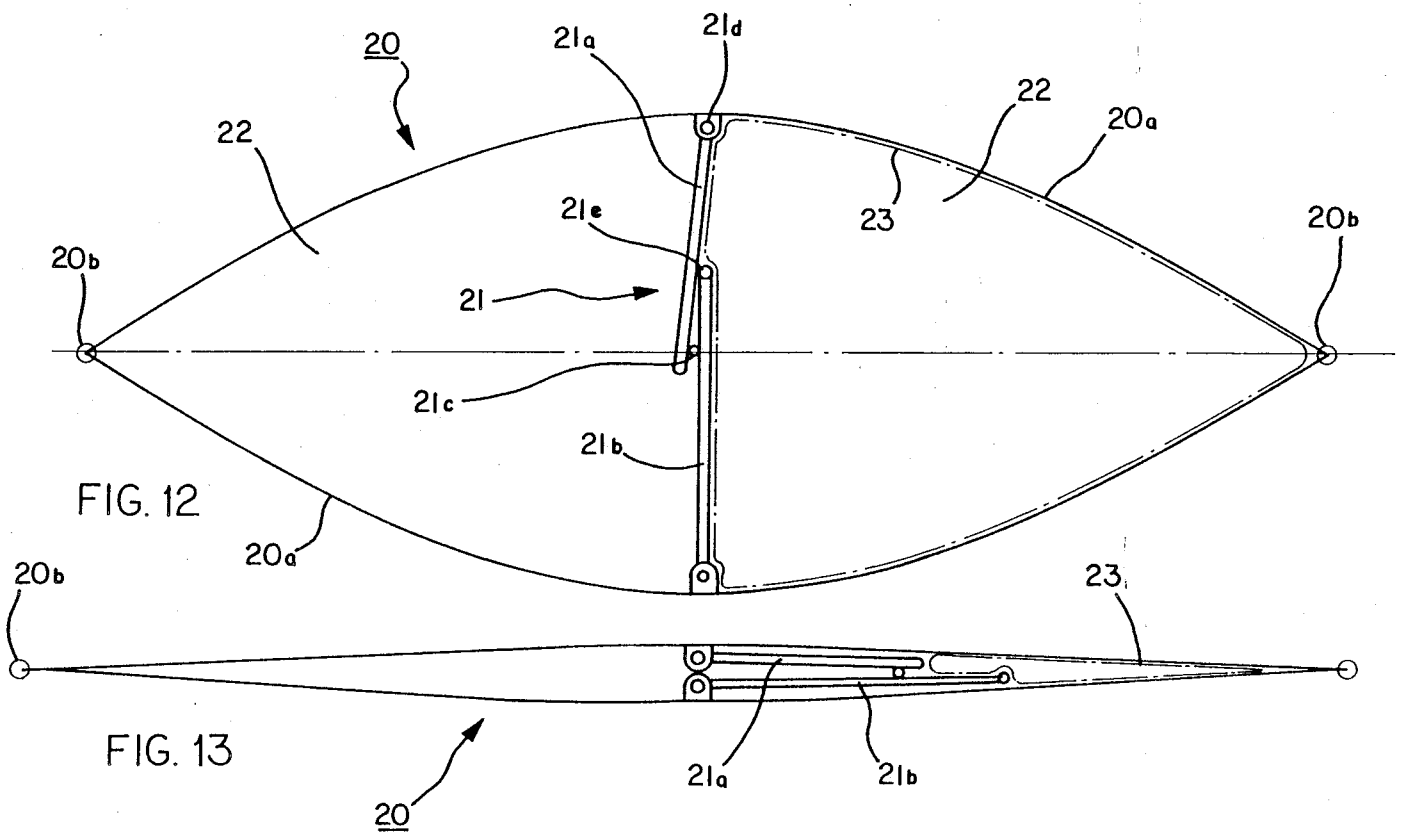
FIG. 12 is a cross-section of a hollow profile bearing structure according to the invention, in operational shape.
FIG. 13 is a cross-section of the bearing structure according to FIG. 8, in rest shape.

In the design according to FIGS. 12 and 13, a bearing structure is provided with a tubular bearing part 20 in the operational shape according to FIG. 12. The latter consists of two lamella 20*a* which are swingably connected with each other at their side edges by elongated joints 20*b*, for example, in the form of hinges or bending joints. For example, by a shaping according to FIG. 6, (not shown in detail here) the lamella 20 are designed to yield in relation to a bending moment acting in the plane of the cross-section, that is, in the plane of the drawing according to FIG. 12, but are relatively rigid in relation to the bending moment acting in the plane of the longitudinal section. The bearing part 20 can easily be converted, therefore, by widening its inner space from the rest shape according to FIG. 13 with slight cross-sectional height into the tubular operational shape according to FIG. 12, and vice versa.

Within the bearing part 20 are arranged first support parts 21 which consist of two plate-like support elements 21*a*, 21*b* extending lengthwise of the bearing part. The latter are connected with each other or with the middle regions of the lamella 20*a* by hinge-type joints 21*c*, 21*d* also extending lengthwise of the bearing part 20. Thus, the support elements 21*a*, 21*b* form a knee lever gear, which in its extended position according to FIG. 11 reached after exceeding the dead point, is secured by laying an upper side edge 21*e* of the bearing element 21*b* against the bearing element 21*a*. The shape-fitting and the peak regions of the lamella 20*a* support each other. Therefore, a fixed cross-sectional height of the bearing structure is maintained. The bearing structure is, therefore, rigid in form against transverse pressure forces introduced into the peak region. At the same time, the support part 21 is effective, under bending stress of the bearing structure, for a high-strength and rigid transmission of thrust tensions between the peak regions of the lamella 20*a* in which the maximum bending stresses occur. Thus, there is given as a whole in the operational shape, a tubular bearing structure of great resistance to bending and torsion and corresponding rigidity of form.

Moreover, there are arranged in two inner chambers 22 separated by the support parts 21, bellows-like second support parts 23 indicated in dot-and-dash line for the right inner chamber only. A filling and emptying device, as known and therefore not shown, and corresponding valves are filled with a pressurized fluid such as a suitable gas for transition to the operational shape, or emptied for transition to the rest shape. The pressurized fluid supports the lamella 20*a* in the operational shape flat against outer pressure forces. The second support parts 23 act also as an easy to handle setting device for the transition to the operational shape.

Figure 14:
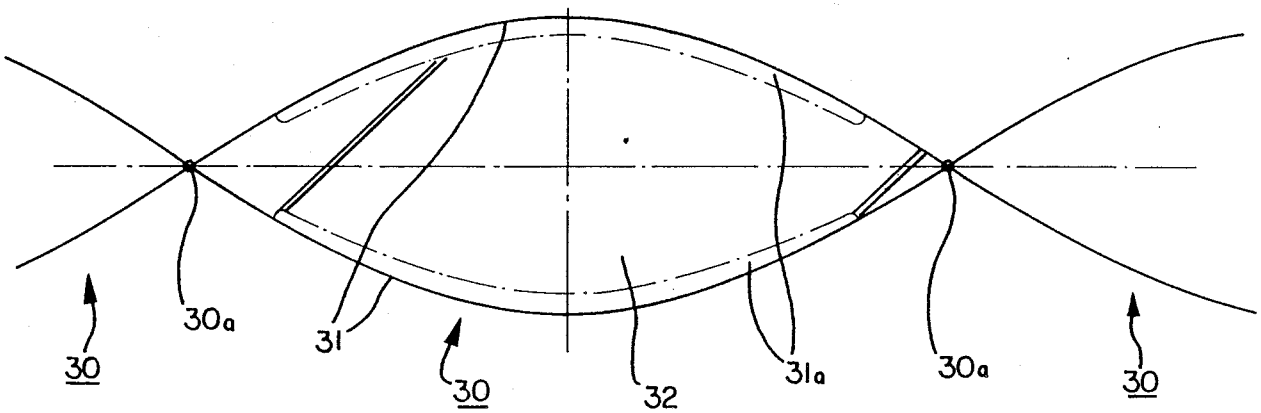
FIG. 14 is a section representation of a multi-member hollow profile bearing structure in operational shape.

FIG. 14 shows a multiple-member arrangement of bearing structures 30, lying side-by-side and tubular in their operational shape, which are connected with each other on their adjoining side edges by hinge-like joints 30*a*. Lamella-like bearing parts 31 are stiffened by wall elements 31*a*, indicated in dot-and-dash line according to FIG. 6, against bending moments acting in the longitudinal plane and against denting by the introduction of pressure forces. The flexibility of the bearing parts 31 in the cross-sectional plane, and thus the easy transition between the rest and the operational shapes, remains unimpaired.

In the design according to FIG. 14, no separate support parts are provided, but these may be arranged additionally if desired, for example, as in the design of FIG. 12.

In the design according to FIG. 14, however, an inner chamber 32 of a bearing structure 30 is made fluid-tight, for example, by an inner coating. The inner coating can be produced directly, in a known manner, with a soft flexible material such as rubber or glued or fastened in a hermetic foil sheath. On the other hand, the desired purpose can be attained merely by laying in a bellows-like support part as in FIG. 14. Here also, the introduction of a pressurized fluid filling into the inner chamber 32 effects the rapid transition from a flat rest shape to a voluminous operational shape strongly bearing and rigid of form. This provides a flat supporting of the bearing structure wall against pressure forces introduced.

Figure 15:
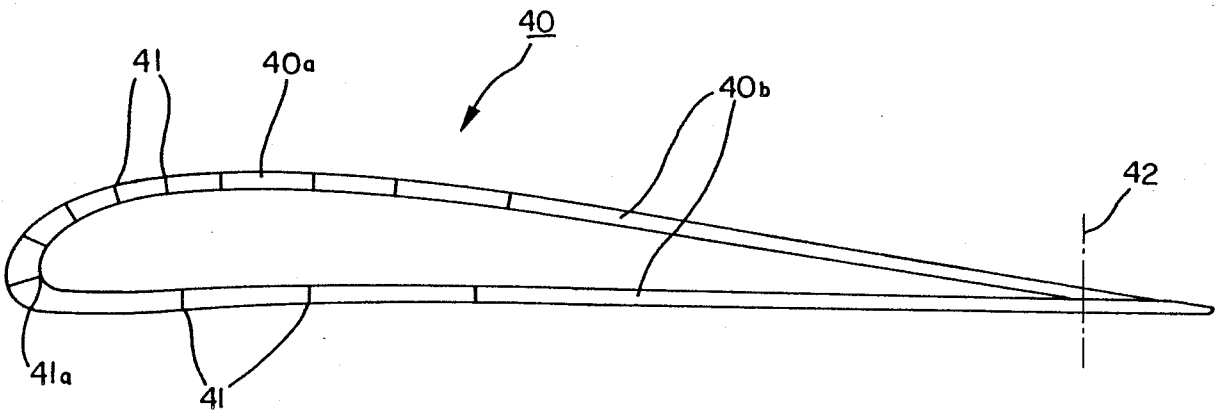
FIG. 15 is a hollow profile bearing structure designed as an aerodynamic lifting body in operational shape.

FIG. 15 shows, as a further example of execution of the invention, an aerodynamic bearing structure 40 with a bearing wing cross-section. The bearing structure wall is shaped as in FIG. 6 and consists of segments 40*a* rigid in form. The segments 40*a* are connected with each other by elongated bending joints 41 in the region of the outer surface of the bearing structure 40. Two segments 40*b* lying against each other, esssentially flat and plate-like and in the region of the rear edge of the bearing structure, are connected with each other by a security against thrust 42, as indicated in dot-and-dash lines. For example, an ordinary, detachable transverse screw 42 can be used. In the operational shape in the manner of FIG. 7, the mutual stopping and side contact of the segments provide a light-weight hollow body rigid in form and with high bearing power. In the region of the front edge of the bearing structure, a joint 41*a* is arranged on the inner surface of the hollow body. In this way, the hollow body, after loosening of the thrust security 42, can be quickly converted into a rest shape of slight cross-sectional height with upper and lower walls lying on one another.

Figure 17:
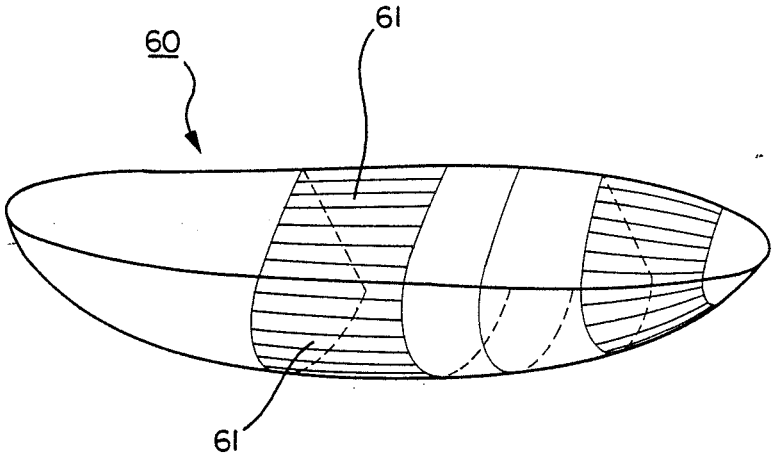
FIG. 17 is a perspective of a bearing structure, designed as a hydrostatic lifting body, in the form of the hull of a boat.
Figure 16:
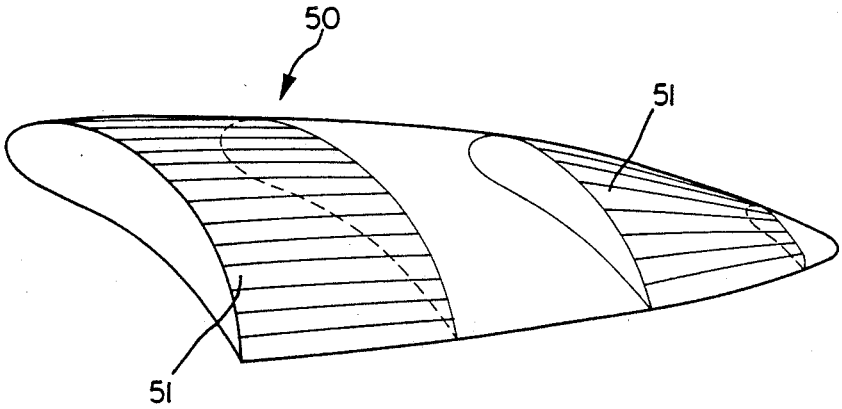
FIG. 16 is a perspective of a varied execution of a hollow profile bearing structure designed as an aerodynamic lifting body in operational shape.
Figure 18:
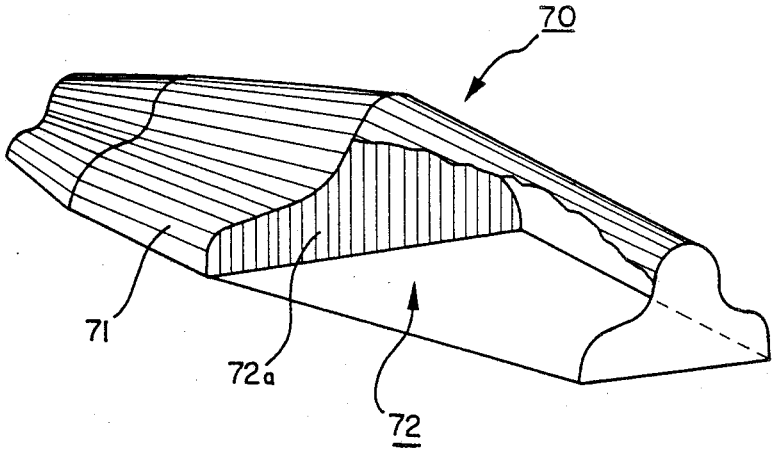
FIG. 18 is a simplified perspective of a multi-membered hall consisting of bearing structures according to the invention.

FIGS. 16 to 18 show forms of execution of bearing structures according to the invention, 50, 60 and 70, respectively, in the form of a bearing wing and a boat hull and a hall-like building. Essential in these designs is the composition of the bearing structure of segments adjoined lengthwise and connected, possibly detachable, with each other. The cross-sectional measurements decrease or increase in the lengthwise direction. In this way, conical shapes of the surface are provided generally. In a composition combined with generally cylindrical segments, versatile possibilities in the design for the operational shape are provided.

A conical shape of the bearing structure or segments thereof is provided in an advantageously simple way by the fact that the wall of the bearing structure or of the bearing structure segments consists of elongated elements lying side-by-side and joined together in the region of their side edges. The elongated elements are designed with a trapezoidal shape of which the side edges run together at acute angles. Such bearing elements are indicated in FIGS. 16 to 18 as 51, 61, and 71, respectively.

In FIG. 18 is indicated also a transverse wall of a hall-like building. A support part 72 consists of bearing elements 72*a* joined together so that they can swing or bend. For example, the bearing elements 72*a* may be connected with the outer wall of the bearing structure, as shown in FIGS. 1 to 5.

Figure 19:
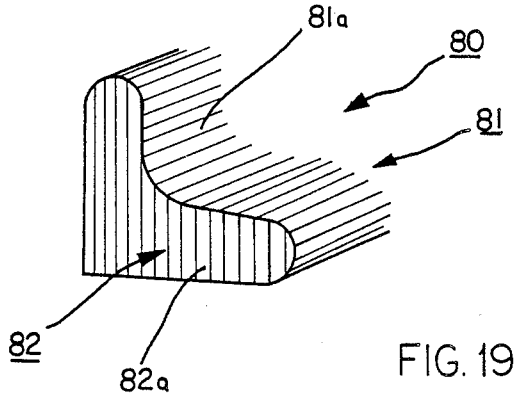
FIG. 19 is a partial perspective of a bearing structure according to the invention designed as a seating bench.

Finally, FIG. 19 shows in section a bearing structure 80, according to the invention, in the form of an especially collapsible seating bench with a bearing part 81, and with bearing elements 81*a* joined together swingably or bendably. Stiffening in the operational shape shown is provided by means of support parts 82 in the form of transverse walls which also consist of bearing elements 82*a* joined together swingably or bendably and connected with the bearing part as shown in FIGS. 1 to 5.

It should be noted that bearing structures according to the invention might be designed also, in particular, as transport containers. In particular, sealed designs may be considered as transport containers for fluids and granulates.

Having described preferred embodiments of the invention, the following is claimed:

1. A seat which is convertible between an operational shape of a greater volume and a compact carrying or rest shape of a lower volume, distinguished by a carrying body which can be rolled up as a whole, having a bearing part serving in the operational shape as a foot and possibly as a leaning part and a support part serving in the operational shape as a seating surface, distinguished by the following features:

said bearing part includes an edge section and another section adjoining against said edge section, said edge section of said bearing part being swingably joined with said support part to permit folding down of said support part at right angles to said edge section after converting said edge section of said bearing part and said support part joined therewith from a rolled-up form into a flat form so that said another section of said bearing part with said support part folded down can be brought closely around said support part;

each of said bearing part and said support part comprises a plurality of rod-forming bearing elements lying close together and substantially rigid against bending in their lengthwise direction which are joined with each other at their adjoining long sides by hinge joints; and said individual bearing elements of said edge section of said bearing part and said individual bearing elements of said support part, in each case, adjoin each other at the end in pairs, with individual joints provided between said individual bearing elements of said edge section of said bearing part and said individual bearing elements of said support part, said bearing elements in said another section being longer than said bearing elements in said edge section.

2. A seat according to claim 1 wherein a closing device is provided to secure said another section of said bearing part in its position brought closely around said support part.

3. A seat according to claim 1 wherein the length of said bearing elements in said another section of said bearing part is selected to be of a length to provide back support for an occupant seated in said seat when said seat is in its operational shape.

4. A seat according to one of claims 1, 2 and 3 wherein said another section of said bearing part includes an offset for receiving an edge zone on the circumference of said support part when said seat is in its operational shape.

5. A seat according to one of claims 1, 2 and 3 wherein said another section of said bearing part includes means defining a groove or channel for receiving an edge zone on the circumference of said support part when said seat is in its operational shape.

6. A seat according to claim 1 wherein said bearing elements are rods of hollow profile.

7. A seat according to claim 1 wherein said joints by which said bearing elements are joined on their adjoining long sides are designed as hinge joints.

8. A seat according to claim 7 wherein said bearing elements have a trapezoidal profile.

9. A seat according to claim 7 or 8 wherein said carrying body is designed in one piece.

10. A structure which can be rolled up as a whole and which is convertible between an operational shape as a seat and a compact carrying or rest shape having a smaller volume than the operational shape, said structure comprising:

a bearing part acting as a support for the structure when the structure is in the operational shape, said bearing part having an edge section and another section adjoining said edge section;

a seat part swingably joined with said edge section of said bearing part and having a seating surface on which a person can sit when the structure is in the operational shape;

each of said bearing and seat parts including rod-shaped bearing elements located close together and being hingably joined with each other along their lengths so that said rod-shaped bearing elements can be rolled up as a whole, said rod-shaped bearing elements being substantially rigid against bending in their lengthwise direction, said rod-shaped bearing elements of said seat part and said rod-shaped bearing elements of said edge section of said bearing part adjoining each other at their ends, said bearing elements of said another section of said bearing part being longer than said bearing elements of said edge section of said bearing part;

an individual hinge provided between said adjoining bearing elements of said seat part and of said edge section of said bearing part to permit folding of said seat part from a first position wherein said seat part lies against said edge section of said bearing part to a second position wherein said seat part extends at a right angle relative to said edge section of said bearing part, said another part of said bearing part being positionable around said seat part; and means for supporting said seat part in said second position.

* * * * *

UNITED STATES PATENT AND TRADEMARK OFFICE

CERTIFICATE OF CORRECTION

PATENT NO. : 4,970,831

DATED : November 20, 1990

INVENTOR(S) : Angelo Rota

It is certified that error appears in the above-identified patent and that said Letters Patent is hereby corrected as shown below:

Column 7, Line 41, Claim 1, change "rod-forming" to --rod-form--.

Signed and Sealed this

Seventeenth Day of March, 1992

*Attest:*

HARRY F. MANBECK, JR.

*Attesting Officer*

*Commissioner of Patents and Trademarks*